US011327431B2

(12) United States Patent
Amann et al.

(10) Patent No.: US 11,327,431 B2
(45) **Date of Patent: *May 10, 2022**

(54) TONER CARTRIDGE HAVING A POSITIONING BOSS

(71) Applicant: LEXMARK INTERNATIONAL, INC., Lexington, KY (US)

(72) Inventors: Mark William Amann, Lexington, KY (US); Brian Lester Boettcher, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/065,667

(22) Filed: Oct. 8, 2020

(65) Prior Publication Data

US 2021/0026291 A1 Jan. 28, 2021

Related U.S. Application Data

(63) Continuation of application No. 16/590,667, filed on Oct. 2, 2019, now Pat. No. 10,838,355, which is a continuation of application No. 16/267,930, filed on Feb. 5, 2019, now Pat. No. 10,474,093.

(51) Int. Cl.

| | |
|---|---|
| ***G03G 21/16*** | (2006.01) |
| ***G03G 15/08*** | (2006.01) |
| ***G03G 21/18*** | (2006.01) |

(52) U.S. Cl.

CPC ..... *G03G 21/1647* (2013.01); *G03G 15/0875* (2013.01); *G03G 21/1676* (2013.01); *G03G 21/1842* (2013.01)

(58) Field of Classification Search

CPC ..... G03G 21/1609; G03G 21/1642; G03G 21/1839; G03G 21/1842

See application file for complete search history.

(56) References Cited

U.S. PATENT DOCUMENTS

| | | | | |
|---|---|---|---|---|
| 10,474,093 | B1 * | 11/2019 | Amann | G03G 21/1676 |
| 2008/0159774 | A1 * | 7/2008 | Tanabe | G03G 21/1842 399/90 |
| 2012/0195627 | A1 * | 8/2012 | Kikuchi | G03G 21/1671 399/110 |

(Continued)

*Primary Examiner* — Thomas S Giampaolo, II
(74) *Attorney, Agent, or Firm* — Justin M. Tromp

(57) ABSTRACT

A toner cartridge includes a photoconductive drum and a boss that protrudes outward from a first longitudinal end of the toner cartridge at a rotational axis of the photoconductive drum. An outermost axial segment of the boss along the rotational axis includes a partial cylinder having a cross-sectional shape of a circular segment. An outer circumferential surface of the partial cylinder is convex to a bottom of the toner cartridge and forms a bottom contact surface of the boss that is unobstructed to contact and sit in a corresponding V-block in an image forming device when the toner cartridge is installed in the image forming device. The outermost axial segment of the boss includes clearance above a topmost portion of the partial cylinder and within the radius of the outer circumferential surface of the partial cylinder permitting the clearance to accommodate one or more features in the image forming device.

6 Claims, 11 Drawing Sheets

(56) References Cited

U.S. PATENT DOCUMENTS

| | | | | |
|---|---|---|---|---|
| 2013/0209141 | A1* | 8/2013 | Hackney | G03G 15/0865 399/262 |
| 2014/0147158 | A1* | 5/2014 | Fujinaka | G03G 21/1652 399/90 |
| 2017/0153596 | A1* | 6/2017 | Takahashi | G03G 15/0863 |

* cited by examiner

TONER CARTRIDGE HAVING A POSITIONING BOSS

CROSS REFERENCES TO RELATED APPLICATIONS

This application is a continuation application of U.S. patent application Ser. No. 16/590,667, filed Oct. 2, 2019, entitled "Toner Cartridge Having a Positioning Boss," which is a continuation application of U.S. patent application Ser. No. 16/267,930, filed Feb. 5, 2019, now U.S. Pat. No. 10,474,093, issued Nov. 12, 2019, entitled "Toner Cartridge Having a Positioning Boss."

BACKGROUND

1. Field of the Disclosure

The present disclosure relates generally to image forming devices and more particularly to a toner cartridge having a positioning boss.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable toner cartridges that have a shorter lifespan than the image forming device. It is important that the toner cartridge(s) are precisely aligned within the image forming device. If a toner cartridge is misaligned, one or more input gears on the toner cartridge may fail to maintain proper gear mesh with corresponding output gears in the image forming device and one or more electrical contacts on the toner cartridge may fail to maintain an electrical connection with corresponding electrical contacts in the image forming device. Further, if a toner cartridge is misaligned, various imaging components of the toner cartridge (such as a photoconductive drum) may be incorrectly positioned relative to the image forming device potentially resulting in toner leakage or print quality defects. The toner cartridge(s) must also be rigidly held in place after installation in the image forming device in order to prevent the positional alignment of the toner cartridge(s) from being disturbed during operation. The requirement for tight positional control must be balanced with the need to permit a user to easily load and unload the toner cartridge(s) into and out of the image forming device. Accordingly, it will be appreciated that precise alignment of the toner cartridge(s) and relatively simple insertion and removal of the toner cartridge(s) into and out of the image forming device is desired.

SUMMARY

A toner cartridge according to one example embodiment includes a housing having a top, a bottom, a first side and a second side positioned between a first longitudinal end and a second longitudinal end of the housing. The housing has a reservoir for holding toner. A photoconductive drum is rotatably positioned on the housing. A portion of an outer surface of the photoconductive drum is positioned along the bottom of the housing. The photoconductive drum includes a rotational axis that runs in a direction from the first longitudinal end to the second longitudinal end. A boss protrudes outward from the first longitudinal end of the housing at the rotational axis of the photoconductive drum. An outermost axial segment of the boss along the rotational axis of the photoconductive drum includes a partial cylinder having a cross-sectional shape of a circular segment of less than 360 degrees circumference. An outer circumferential surface of the partial cylinder is convex to the bottom of the housing and forms a bottom contact surface of the boss that is unobstructed to contact and sit in a corresponding V-block in an image forming device when the toner cartridge is installed in the image forming device. The outer circumferential surface of the partial cylinder has a radius. The outermost axial segment of the boss includes clearance above a topmost portion of the partial cylinder and within the radius of the outer circumferential surface of the partial cylinder permitting the clearance to accommodate one or more features in the image forming device during installation of the toner cartridge into the image forming device. In some embodiments, the partial cylinder has a cross-sectional shape of a circular segment of greater than 180 degrees circumference.

Embodiments include those wherein the outer circumferential surface of the partial cylinder has a constant radius.

In some embodiments, the radius of the outer circumferential surface of the partial cylinder is centered about the rotational axis of the photoconductive drum.

Embodiments include those wherein the outermost axial segment of the boss includes a flat segment that is positioned on top of the partial cylinder and that extends from a first circumferential end of the partial cylinder to a second circumferential end of the partial cylinder. The clearance is positioned immediately above the flat segment.

Some embodiments include a drive coupler on the second longitudinal end of the housing for mating with a corresponding drive coupler in the image forming device for receiving rotational motion from the corresponding drive coupler in the image forming device when the toner cartridge is installed in the image forming device. The drive coupler of the toner cartridge is operatively connected to the photoconductive drum to transfer rotational motion to the photoconductive claim.

A toner cartridge according to another example embodiment includes a housing having a top, a bottom, a first side and a second side positioned between a first longitudinal end and a second longitudinal end of the housing. The housing has a reservoir for holding toner. A photoconductive drum is rotatably positioned on the housing. A portion of an outer surface of the photoconductive drum is positioned along the bottom of the housing. The photoconductive drum includes a rotational axis that runs in a direction from the first longitudinal end to the second longitudinal end. A D-shaped boss protrudes outward from the first longitudinal end of the housing at the rotational axis of the photoconductive drum. The D-shaped boss includes a rounded bottom contact surface that is unobstructed to contact and sit in a corresponding V-block in an image forming device when the toner cartridge is installed in the image forming device. The D-shaped boss includes a planar top surface.

A toner cartridge according to another example embodiment includes a housing having a top, a bottom, a first side and a second side positioned between a first longitudinal end and a second longitudinal end of the housing. The housing has a reservoir for holding toner. A photoconductive drum is rotatably positioned on the housing. A portion of an outer surface of the photoconductive drum is positioned along the bottom of the housing. The photoconductive drum includes a rotational axis that runs in a direction from the first longitudinal end to the second longitudinal end. A boss protrudes outward from the first longitudinal end of the housing at the rotational axis of the photoconductive drum. The boss includes a rounded contact surface that is convex to the bottom of the housing and that is unobstructed to contact and sit in a corresponding V-block in an image forming device when the toner cartridge is installed in the image forming device. The rounded contact surface has a radius. A volume of space above a topmost portion of the boss and within the radius of the rounded contact surface of the boss is free of material for accommodating one or more features in the image forming device during installation of the toner cartridge into the image forming device.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
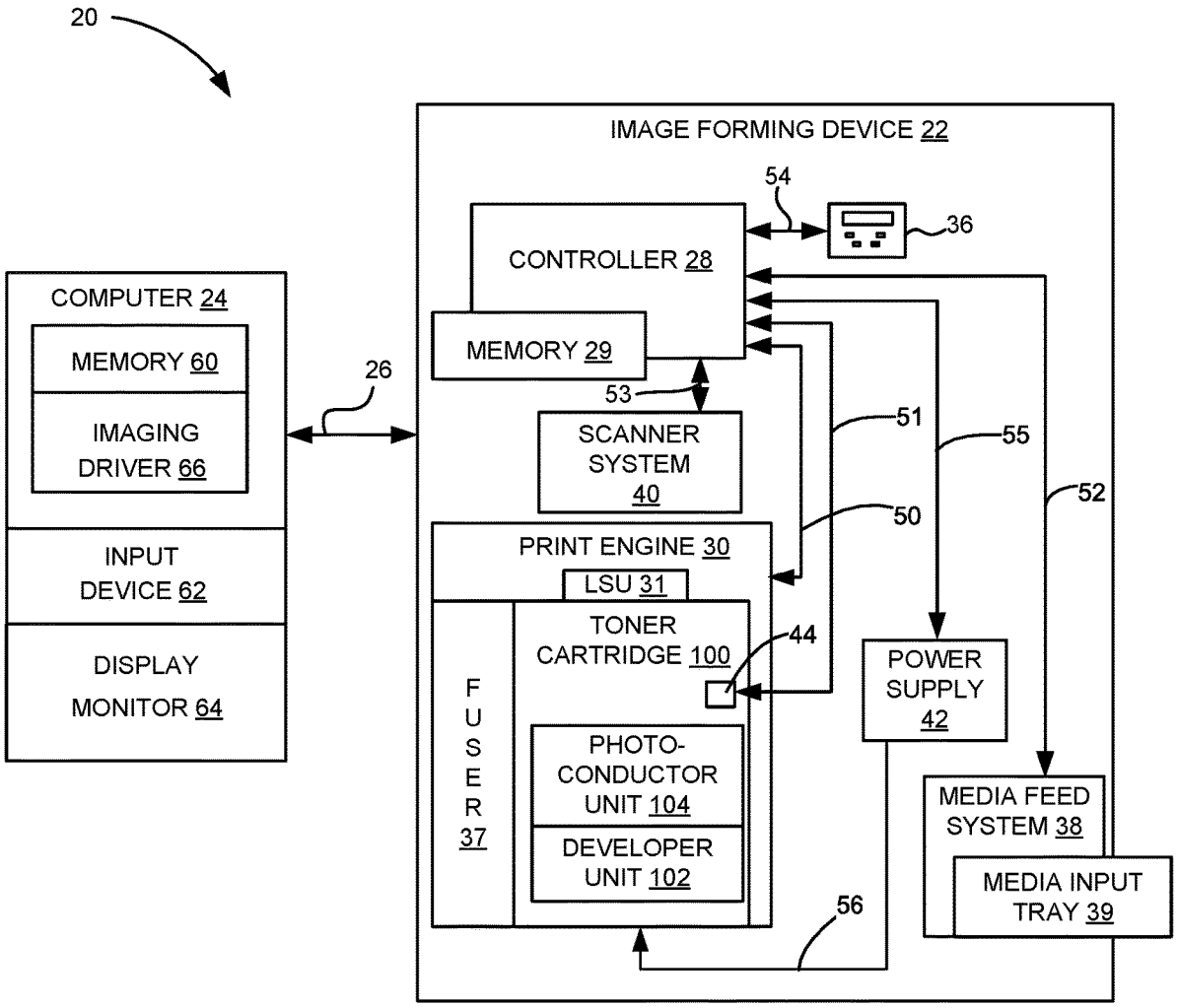
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or MD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably, mounted in image forming device 22. Power supply 42 provides an electrical voltage to various components of toner cartridge 100 via an electrical path 56. Toner cartridge 100 includes a developer unit 102 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of developer unit 102 is mixed with magnetic carrier heads. The magnetic carrier beads may be coated with a polymeric film to provide triboelectric properties to attract toner to the carrier beads as the toner and the magnetic carrier beads are mixed in the toner reservoir. In this embodiment, developer unit 102 includes a developer roll that attracts the magnetic carrier beads having toner thereon to the developer roll through the use of magnetic fields. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color e.g., black, cyan, yellow and magenta) to permit color printing.

Figure 2:
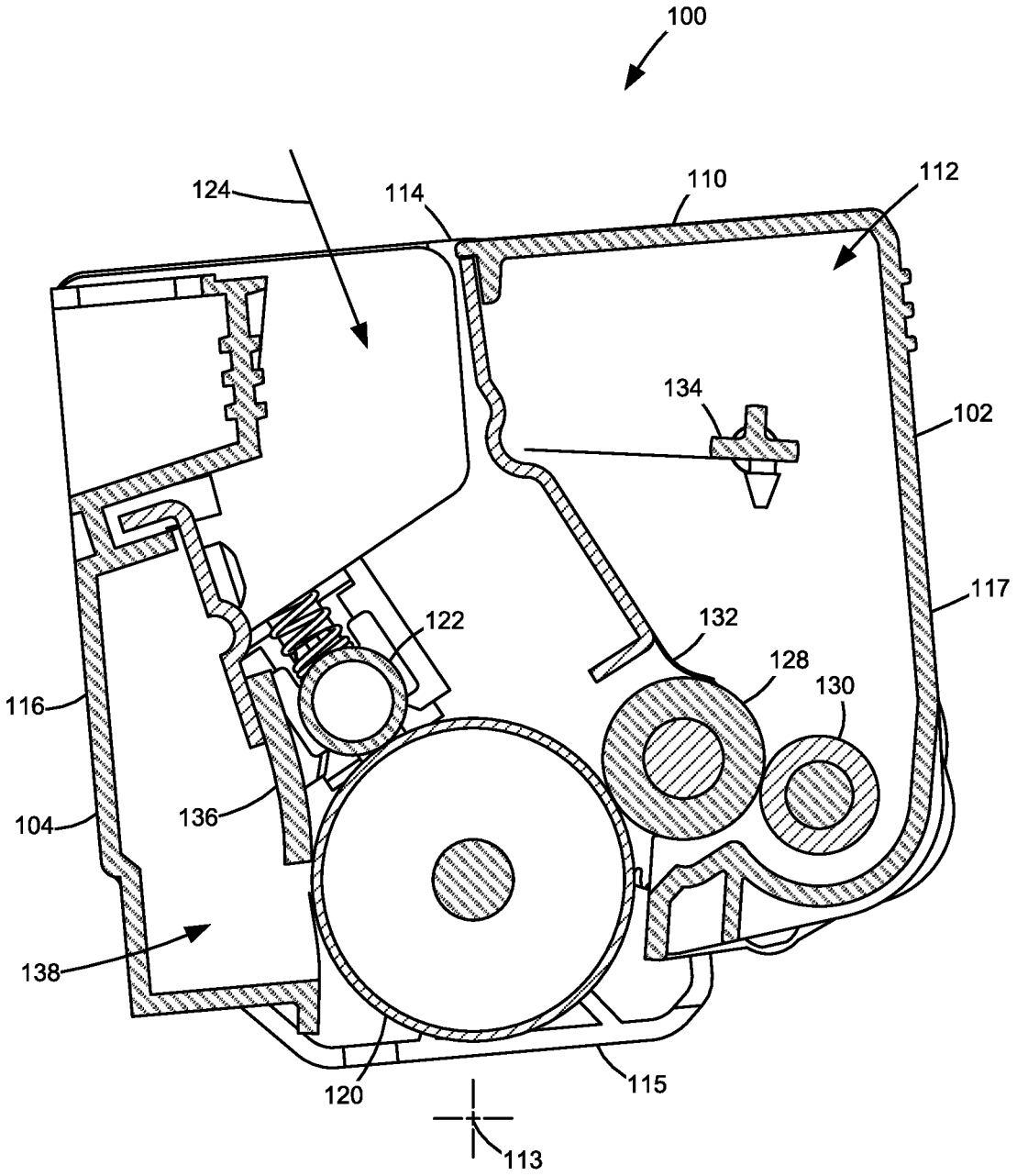
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. In the example embodiment illustrated, housing 110 extends along a longitudinal dimension 113 and includes a top 114, a bottom 115, a side 116 and a side 117 that extend between longitudinal ends 118, 119 (FIGS. 3 and 4) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIG. 4) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG.

1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
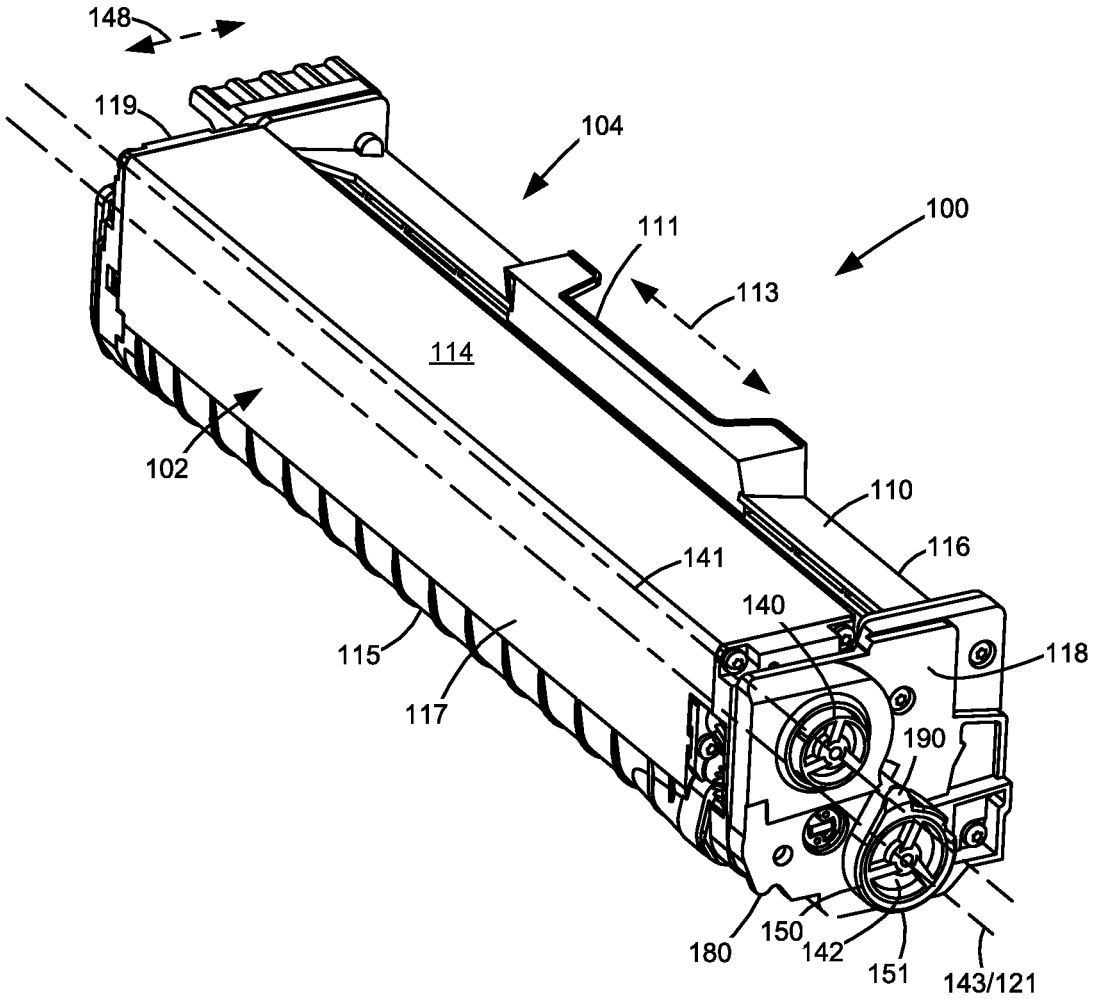
FIGS. 3 and 4 are perspective views of the toner cartridge according to one example embodiment.
Figure 4:
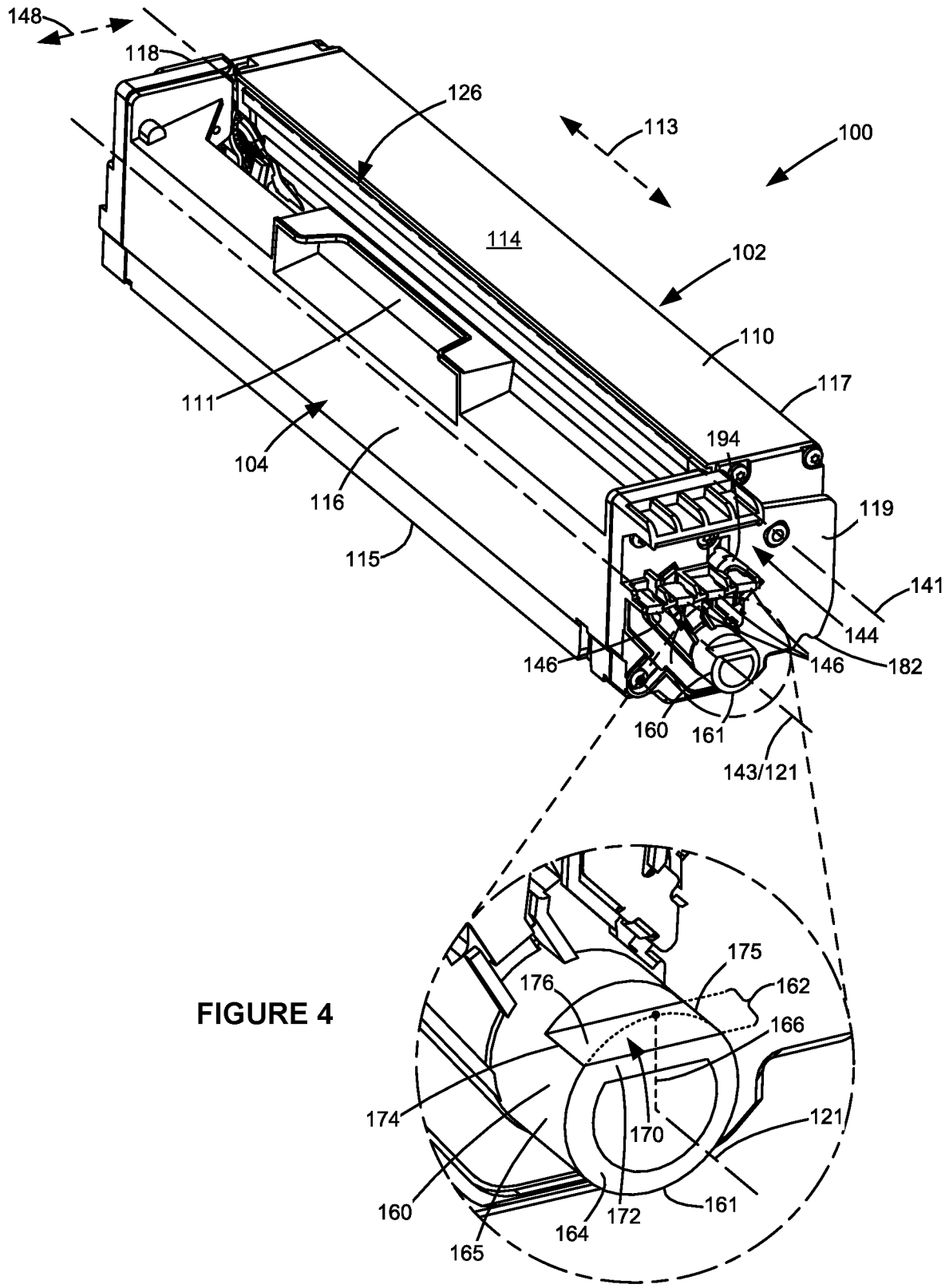
Figure 5:
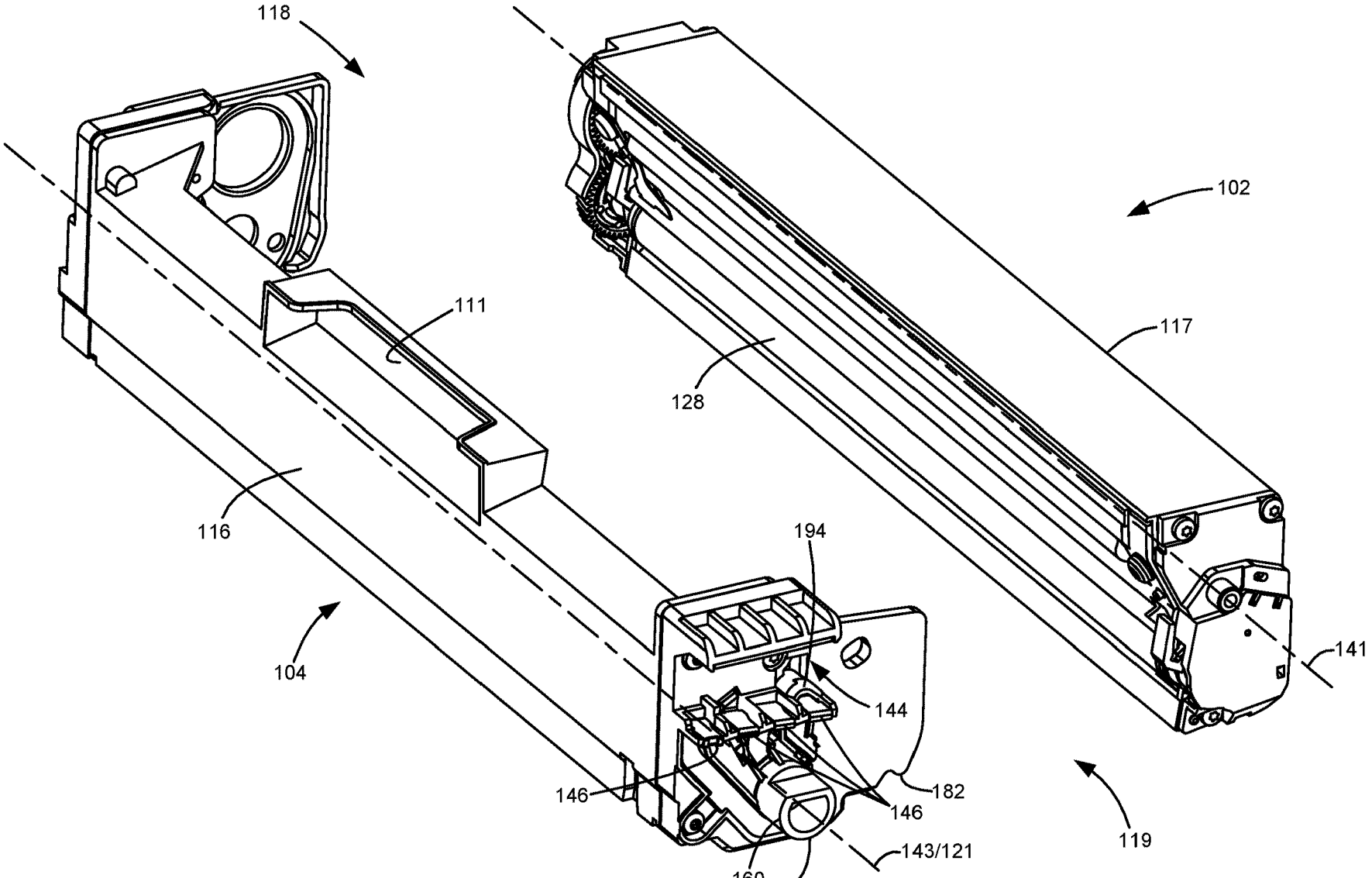
FIG. 5 is an exploded view of the toner cartridge shown in FIGS. 3 and 4 showing a developer unit and a photoconductor unit of the toner cartridge according to one example embodiment.

FIGS. 3-5 show the exterior of toner cartridge 100 according to one example embodiment. As shown, in this embodiment, developer unit 102 is positioned at side 117 of housing 110 and photoconductor unit 104 is positioned at side 116 of housing 110. FIG. 5 shows developer unit 102 separated from photoconductor unit 104 with developer roll 128 exposed on developer unit 102 for mating with photoconductive drum 120. In the example embodiment illustrated, toner cartridge 100 includes a handle 111 positioned along side 116 and/or top 114 of housing 110 to assist the user with handling toner cartridge 100.

Figure 6:
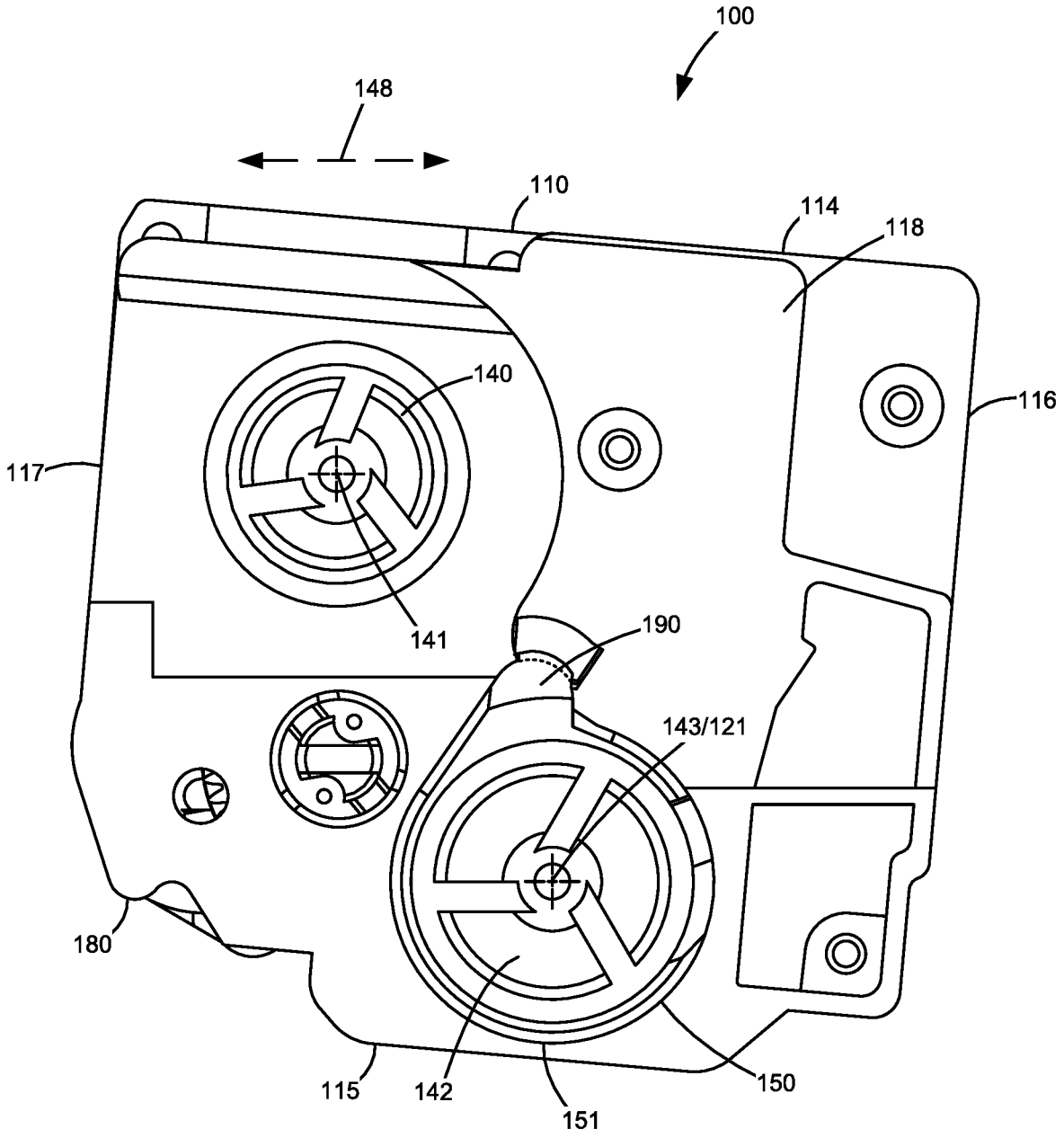
FIG. 6 is a first side elevation view of the toner cartridge of FIGS. 3-5 according to one example embodiment.

With reference to FIGS. 3 and 6, in the example embodiment illustrated, a pair of drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor(s) to a pair of drive couplers that mate with drive couplers 140, 142 of toner cartridge 100 when toner cartridge 100 is installed in image forming device 22. In the example embodiment illustrated, drive couplers 140, 142 are each exposed on end 118 of housing 110. Each drive coupler 140, 142 includes a rotational axis 141, 143. In the example embodiment illustrated, drive couplers 140, 142 are each configured to mate with and receive rotational motion from the corresponding drive couplers in image forming device 22 at the axial ends of drive couplers 140, 142. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly as in the embodiment illustrated or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears.

Figure 7:
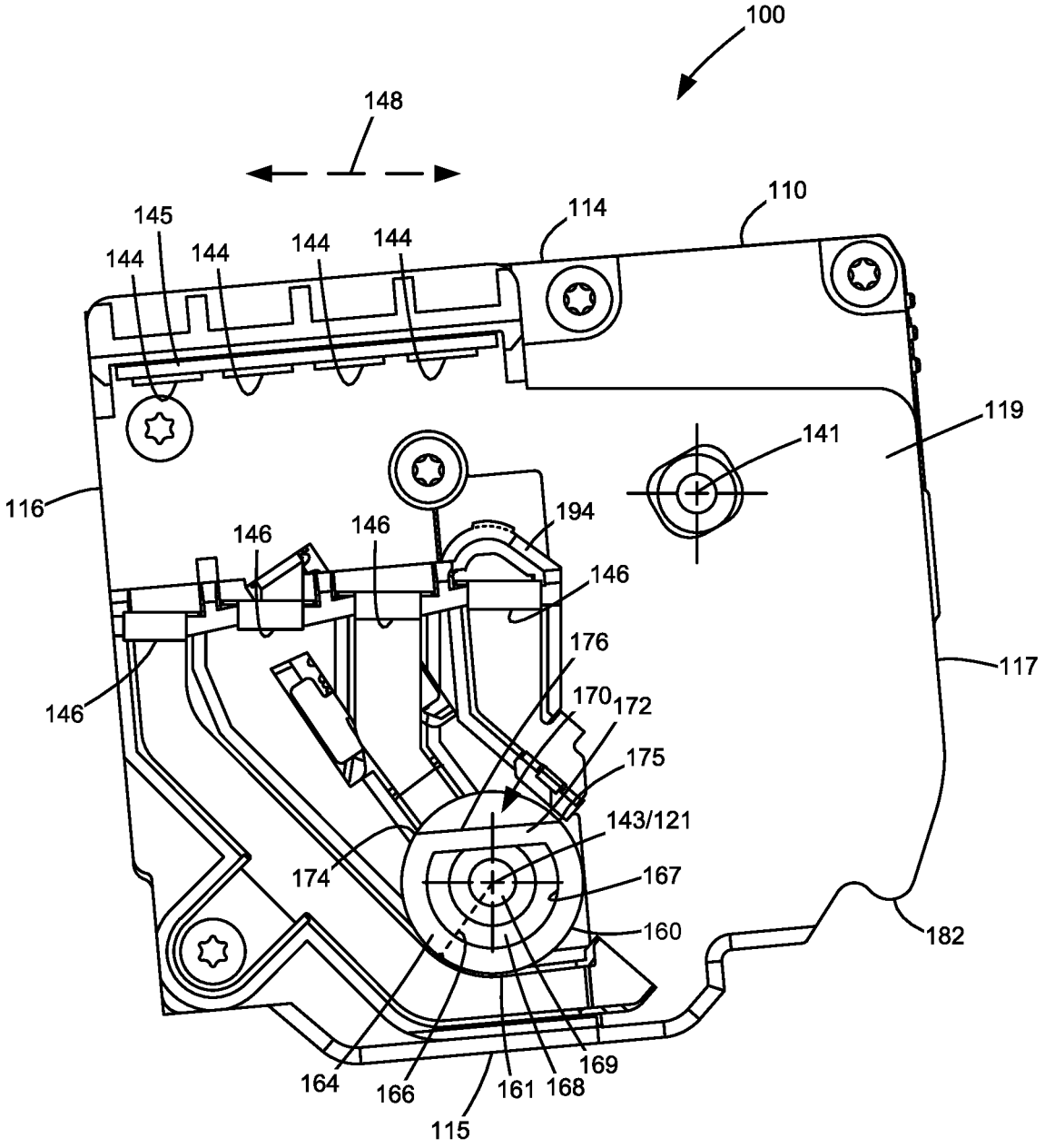
FIG. 7 is a second side elevation view of the toner cartridge of FIGS. 3-6 according to one example embodiment.

With reference to FIGS. 4 and 7, in the example embodiment illustrated, toner cartridge 100 includes one or more electrical contacts 144 positioned on end 119 of housing 110 and electrically connected to processing circuitry 44 and one or more electrical contacts 146 positioned on end 119 of housing 110 and electrically connected to one or more imaging components of toner cartridge 100. Electrical contacts 144 and 146 are positioned to contact corresponding electrical contacts in image forming device 22 when toner cartridge 100 is installed in image forming device 22 in order to facilitate communications link 51 between processing circuitry 44 and controller 28 and electrical path 56 between the one or more imaging components of toner cartridge 100 and power supply 42. In the example embodiment illustrated, electrical contacts 144 are positioned on a printed circuit board 145 that is mounted to housing 110 and that includes processing circuitry 44 thereon. In another embodiment, processing circuitry 44 is positioned elsewhere on housing 110 and is electrically connected to electrical contacts 144, for example, by suitable traces or cabling. In the example embodiment illustrated, electrical contacts 146 include discrete electrical contacts each electrically connected to one of photoconductive drum 120, charge roll 122, developer roll 128 and toner adder roll 130.

Electrical contacts 144 and 146 are unobstructed on end 119 of housing 110 permitting electrical contacts 144 and 146 to mate with corresponding electrical contacts in image forming device 22 upon installation of toner cartridge 100 into image forming device 22. In the example embodiment illustrated, electrical contacts 144 and 146 are each exposed and unobstructed from below (in a direction from bottom 115 to top 114 of housing 110) permitting the corresponding electrical contacts in image forming device 22 to contact electrical contacts 144 and 146 from below upon installation of toner cartridge 100 into image forming device 22. In the example embodiment illustrated, electrical contacts 144 are positioned higher than electrical contacts 146, such as directly above electrical contacts 146 as shown. In this embodiment, electrical contacts 144 and 146 extend outward, away from end 119, along an axial dimension of photoconductive drum 120. In the example embodiment illustrated, electrical contacts 144 are positioned adjacent to the top 114 of housing 110, higher than rotational axes 141, 143 of drive couplers 140, 142 and higher than rotational axis 121 of photoconductive drum 120). In this embodiment, electrical contacts 146 are positioned approximately midway up end 119 of housing 110, higher than rotational axis 143 of drive coupler 142 and higher than rotational axis 121 of photoconductive drum 120, but lower than rotational axis 141 of drive coupler 140. In the example embodiment illustrated, electrical contacts 144 and 146 are positioned adjacent to side 116 of housing 110. Electrical contacts 144 are aligned with electrical contacts 146 along a lateral dimension 148 of housing 110 that runs from side 116 to side 117, orthogonal to longitudinal dimension 113, such that electrical contacts 144 overlap with electrical contacts 146 along lateral dimension 148. Electrical contacts 144, 146 are spaced toward side 116 of housing 110 from rotational axis 141 of drive coupler 140, which is positioned closer to side 117 of housing 110 than to side 116 of housing 110 in the embodiment illustrated.

With reference to FIGS. 3-7, in the example embodiment illustrated, toner cartridge 100 includes a pair of positioning bosses 150, 160 that each protrude outward away from a respective end 118, 119 of housing 110 at and along a rotational axis 121 of photoconductive drum 120. Boss 150 is positioned on end 118 of housing 110 and at least partially encircles drive coupler 142. Boss 160 is positioned on end 119 of housing 110 at rotational axes 121 and 143 of photoconductive drum 120 and drive coupler 142. Each boss 150, 160 is unobstructed from below permitting the boss 150, 160 to contact and sit in a corresponding V-block in image forming device 22 in order to define a vertical position of toner cartridge 100 and a horizontal position of toner cartridge 100 along lateral dimension 148. In the example embodiment illustrated, a bottom portion of each boss 150, 160 includes a rounded bottom surface 151, 161, e.g., formed along an arc of a circle, that contacts and sits in the corresponding V-block in image forming device 22. In the embodiment illustrated, each boss 150, 160 is formed integrally with a respective end 118, 119 of housing 110.

With reference to FIGS. 4 and 7, in the example embodiment illustrated, boss 160 is generally D-shaped. In this embodiment, an outermost axial segment 162 of boss 160 along the axial dimension of photoconductive drum 120 includes a partial cylinder 164 having a cross-sectional shape of a circular segment of less than 360 degrees circumference, including, for example, greater than 180 degrees circumference and less than 360 degrees circumference as illustrated. In other embodiments, partial cylinder 164 may have a cross-sectional shape of a circular segment of less than 180 degrees circumference or may be formed by a series of circumferentially spaced circular segments. An outer circumferential surface 165 of partial cylinder 164 is convex to the bottom 115 of housing 110 and forms rounded bottom surface 161 of boss 160 that contacts the corresponding V-block in image forming device 22. In the embodiment illustrated, outer circumferential surface 165 of partial cylinder 164 of boss 160 includes a constant radius 166 that is centered about rotational axis 121 of photoconductive drum 120 in order to provide optimal positioning of photoconductive drum 120 relative to image forming device 22. Partial cylinder 164 may include an inner circumferential surface 167 that is spaced from rotational axis 121 of photoconductive drum 120 as illustrated or partial cylinder 164 may be solid from outer circumferential surface 165 to rotational axis 121 of photoconductive drum 120. In the example embodiment illustrated, an extension of inner circumferential surface 167 of partial cylinder 164 that is inset from outermost axial segment 162 of boss 160 receives and locates a bushing 168 that rotatably supports one end of a shaft 169 of photoconductive drum 120.

Outermost axial segment 162 of boss 160 includes clearance 170 above a topmost portion of partial cylinder 164 within the radius 166 of partial cylinder 164. In this manner, a volume of space above a topmost portion of partial cylinder 164 and within the radius 166 measured from rotational axis 121 of photoconductive drum 120 to outer circumferential surface 165 of partial cylinder 164 is free of material, permitting the volume of clearance 170 to accommodate features in image forming device 22 that, without clearance 170, would otherwise interfere with outermost axial segment 162 of boss 160 during installation of toner cartridge 100 into image forming device 22 as discussed in greater detail below.

In the example embodiment illustrated, outermost axial segment 162 of boss 160 includes a flat segment 172 formed integrally with and on top of partial cylinder 164. In this manner, flat segment 172 extends from one circumferential end 174 of partial cylinder 164 to the other circumferential end 175 of partial cylinder 164. Flat segment 172 includes a planar top surface 176 with clearance 170 positioned immediately above top surface 176. In other embodiments, outermost axial segment 162 of boss 160 may include other shapes and configurations on top of partial cylinder 164 including other structures on top of partial cylinder 164 or simply a gap between circumferential ends 174, 175 of partial cylinder 164.

With reference back to FIGS. 3-7, in the example embodiment illustrated, toner cartridge 100 includes a pair of rotational stops 180, 182 that prevent rotation of toner cartridge 100 about an axis parallel to longitudinal dimension 113 of housing 110 when toner cartridge 100 is installed in image forming device 22. Each rotational stop 180, 182 is positioned along the bottom 115 of housing 110 at side 117 of housing 110 at a respective end 118, 119 of housing 110. In the embodiment illustrated, rotational stops 180, 182 are formed by members, such as extensions or feet, that protrude downward from the bottom 115 of housing 110 at ends 118, 119 of housing 110. Each rotational stop 180, 182 is unobstructed from below permitting each rotational stop 180, 182 to contact a corresponding portion of a frame in image forming device 22 in order to define a rotational position of toner cartridge 100. In the embodiment illustrated, each rotational stop 180, 182 is formed integrally with a respective end 118, 119 of housing 110 and corresponding boss 150, 160.

Toner cartridge 100 also includes a pair of hold-down engagement members 190, 194 that each contact a corresponding hold-down in image forming device 22 and receive a corresponding bias force to maintain contact between bosses 150, 160 of toner cartridge 100 and the corresponding V-blocks in image forming device 22 and between rotational stops 180, 182 of toner cartridge 100 and the corresponding portions of the frame in image forming device 22 during operation of toner cartridge 100 in image forming device 22. Engagement member 190 is positioned on end 118 and engagement member 194 is positioned on end 119. In the example embodiment illustrated, engagement member 190 is formed integrally with boss 150 and end 118 of housing 110 and engagement member 194 is formed integrally with end 119 of housing 110 including a portion of housing 110 that protrudes outward away from end 119 and that supports electrical contacts 146. Each engagement member 190, 194 is unobstructed from above permitting the corresponding hold-downs in image forming device 22 to contact engagement members 190, 194 from above in order to apply a downward force on engagement members 190, 194, including, for example, a primarily downward force on engagement members 190, 194.

Figure 8:
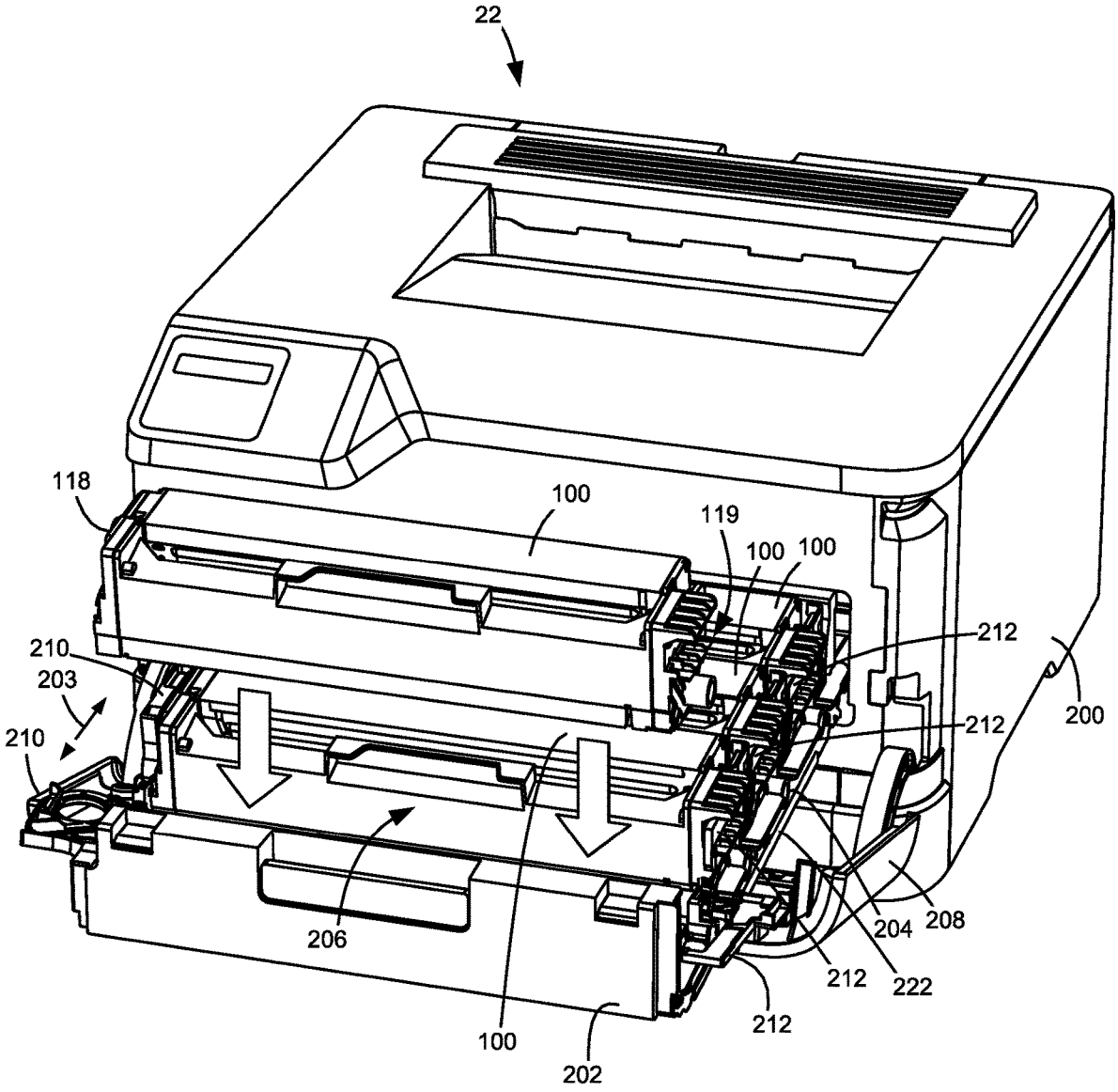
FIG. 8 is a perspective view of an image forming device showing a drawer having a basket for holding four toner cartridges according to one example embodiment.

FIG. 8 shows image forming device 22 according to one example embodiment. In this embodiment, image forming device 22 includes a housing 200 and a drawer 202 mounted on housing 200. Drawer 202 is slidable into and out of housing 200 along a sliding direction 203 between an open position (shown in FIG. 8) and a closed position. Drawer 202 includes a basket 204 configured to receive and support four toner cartridges 100 in image forming device 22. In this embodiment, each of the four toner cartridges 100 is substantially the same except for the color of the toner contained therein. Toner cartridges 100 are vertically insertable into and removable from four corresponding positioning slots 206 of basket 204. Positioning slots 206 of basket 204 locate toner cartridges 100 in their operating positions within image forming device 22 when toner cartridges 100 are installed in basket 204 and drawer 202 is closed. In the embodiment illustrated, drawer 202 is accessible through an access door 208 of image forming device 22.

In the example embodiment illustrated, each positioning slot 206 includes a pair of corresponding latches 210, 212 that secure a respective toner cartridge 100 in basket 204. One latch 210 is positioned at a first end of the positioning slot 206 proximate to end 118 of the corresponding toner cartridge 100 and the other latch 212 is positioned at an opposite end of the positioning slot 206 proximate to end 119 of the corresponding toner cartridge 100. FIG. 8 shows a first toner cartridge 100 removed from its corresponding positioning slot 206 in basket 204 and a pair of corresponding latches 210, 212 in unlatched positions. FIG. 8 shows the other three toner cartridges 100 of image forming device 22 installed in their corresponding positioning slots 206 in basket 204 and their corresponding latches 210, 212 in latched positions securing the three toner cartridges 100 in basket 204. In the example embodiment illustrated, each latch 210, 212 is manually movable between a latched position and an unlatched position permitting a user to selectively secure a particular toner cartridge 100 to basket 204 or remove a particular toner cartridge 100 from basket 204. In this embodiment, latches 210, 212 are pivotable between their latched and unlatched positions about respective pivot axes that run along sliding direction 203 of drawer 202; however, latches 210, 212 may move in other manners as desired.

Figure 9:
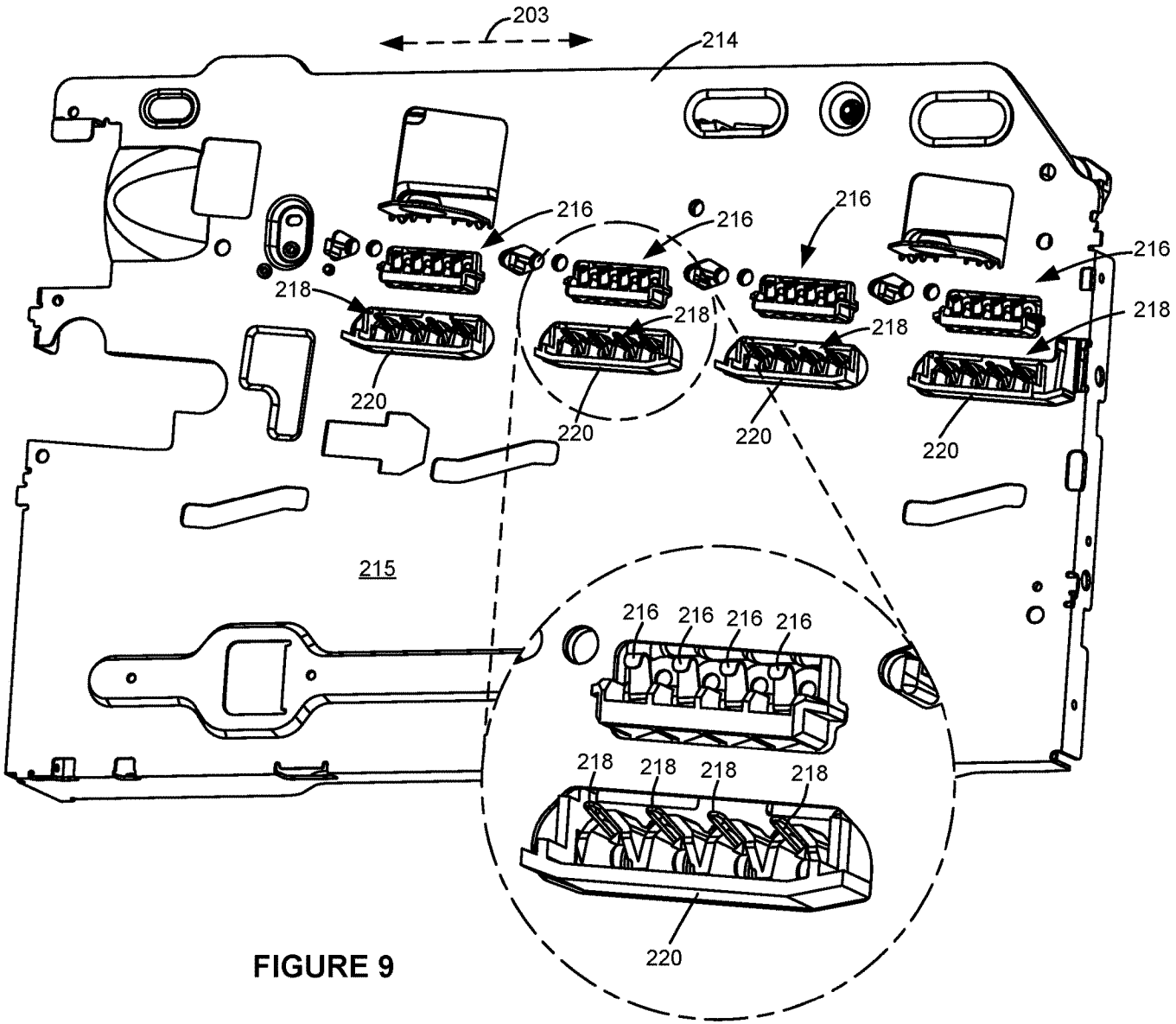
FIG. 9 is a perspective view of a side frame of the image forming device according to one example embodiment.

FIG. 9 shows a side frame 214 that forms part of housing 200 of image forming device 22. Side frame 214 is positioned in an interior portion of image forming device 22 that receives drawer 202 having basket 204 holding the toner cartridges 100 of image forming device 22. Side frame 214 extends along sliding direction 203 of drawer 202 as illustrated. A face 215 of side frame 214 is positioned proximate to ends 119 of housings 110 of toner cartridges 100 when toner cartridges 100 are installed in image forming device 22. Face 215 of side frame 214 includes a set of one or more electrical contacts 216 for each toner cartridge 100 of basket 204 that contact electrical contacts 144 of the corresponding toner cartridge 100 when toner cartridges 100 are installed in image forming device 22 in order to facilitate a communications link 51 between processing circuitry 44 of each toner cartridge 100 and controller 28. Face 215 of side frame 214 also includes a set of one or more electrical contacts 218 for each toner cartridge 100 of basket 204 that contact electrical contacts 146 of the corresponding toner cartridge 100 when toner cartridges 100 are installed in image forming device 22 in order to facilitate an electrical path 56 between the imaging components of each toner cartridge 100 and power supply 42. Face 215 of side frame 214 also includes an upstop 220 positioned below each set of electrical contacts 218. Each upstop 220 includes a rib or the like that projects outward from face 215 toward basket 204. Upstops 220 are positioned to limit upward movement of basket 204 during movement of drawer 202 into or out of image forming device 22 in order to protect electrical contacts 216, 218 and other components of image forming device 22 and toner cartridges 100 from damage. Specifically, upstops 220 are positioned to contact a rib 222 (FIG. 8) that projects outward from a side portion of basket 204 toward side frame 214 if basket 204 lifts or tips upward during insertion into or removal from image forming device 22.

Figure 10:
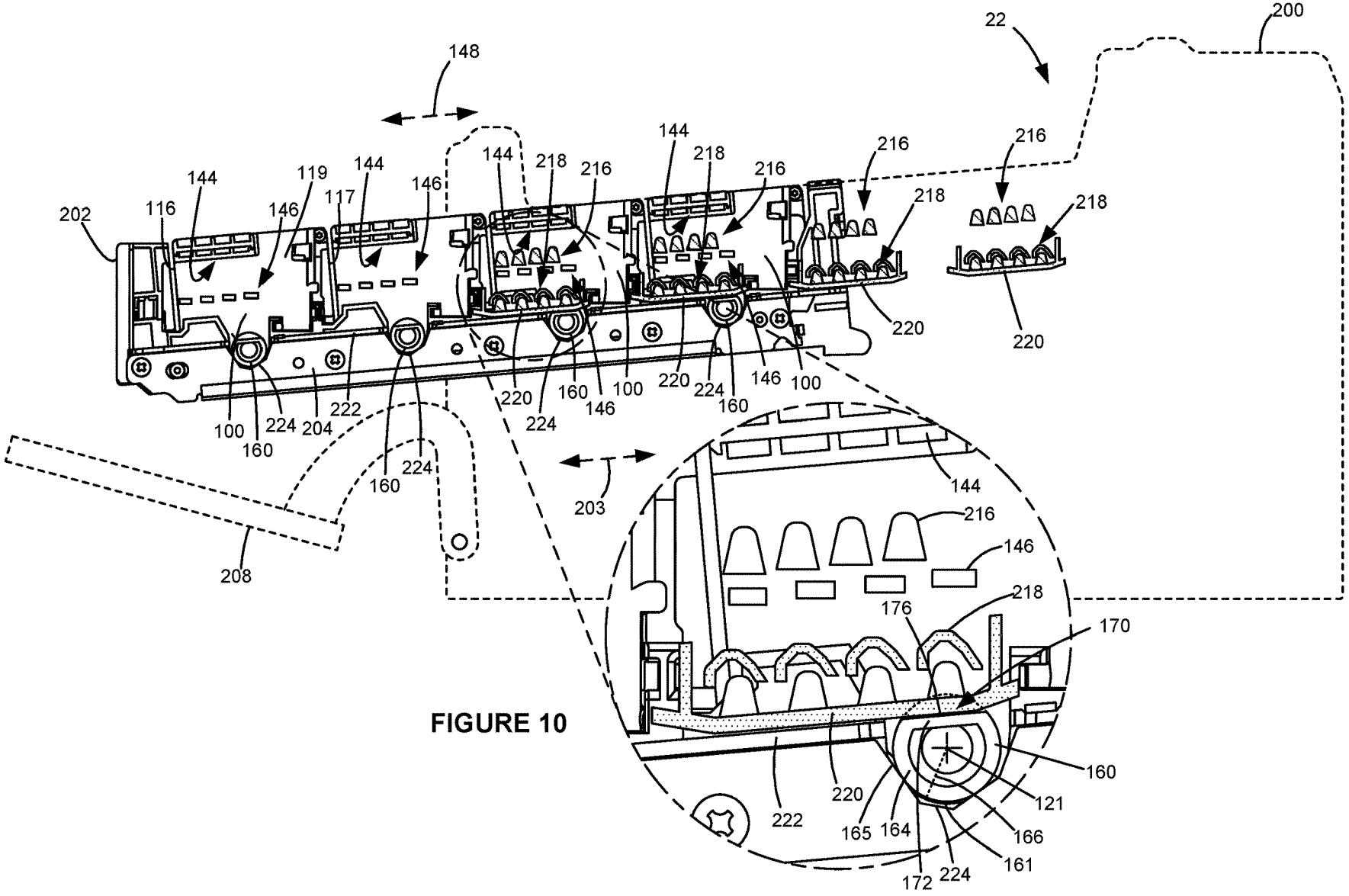
FIG. 10 is a side elevation view illustrating the positions of the four toner cartridges relative to components on the side frame of the image forming device as the drawer moves between an open position and a closed position according to one example embodiment.

FIG. 10 illustrates the positions of electrical contacts 144 and 146 and boss 160 of four toner cartridges 100 in basket 204 relative to corresponding electrical contacts 216, 218 and to upstop 220 of image forming device 22 as drawer 202 moves between an open position and a closed position. FIG. 10 shows drawer 202 slid midway into housing 200. For purposes of clarity, FIG. 10 shows a schematic outline of housing 200 and access door 208 as well as an indication of the positions of electrical contacts 216, 218 and upstop 220 on side frame 214, but omits other features of image forming device 22, FIG. 10 shows bosses 160 of toner cartridges 100 positioned in corresponding V-blocks 224 of basket 204. Contact between each boss 160 and V-block 224 (and between each boss 150 and a corresponding V-block of basket 204) defines a horizontal position of each toner cartridge 100 along lateral dimension 148 and a vertical position of each toner cartridge 100. In particular, contact between each boss 160 and V-block 224 (and between each boss 150 and a corresponding V-block of basket 204) defines a horizontal position of each photoconductive drum 120 along lateral dimension 148 and a vertical position of each photoconductive drum 120 in order to ensure that the toned image from each photoconductive drum 120 is accurately transferred to the print media or intermediate transfer member. As mentioned above, when latches 210, 212 are in their latched positions, hold-downs on latches 210, 212 contact hold-down engagement members 190, 194 of each toner cartridge 100 and provide a bias force in order to maintain contact between bosses 150, 160 of toner cartridge 100 and their corresponding V-blocks on basket 204.

When drawer 202 slides into housing 200 of image forming device 22 with toner cartridges 100 installed in basket 204, side 117 of each toner cartridge 100 leads and side 116 of each toner cartridge 100 trails and the opposite occurs when drawer 202 slides out of housing 200 of image forming device 22. As drawer 202 slides into and out of housing 200 of image forming device 22 along sliding direction 203, electrical contacts 144 of toner cartridges 100 pass over corresponding electrical contacts 216 on side frame 214 and electrical contacts 146 of toner cartridges 100 pass over corresponding electrical contacts 218 on side frame 214 and under electrical contacts 216 on side frame 214. During normal insertion or removal of drawer 202 into or from image forming device 22, rib 222 on basket 204 and bosses 160 of toner cartridges 100 pass under upstops 220 on side frame 214. In particular, as shown in FIG. 10, upstops 220 pass through the volume of clearance 170 positioned above each boss 160 as drawer 202 slides into and out of housing 200 of image forming device 22. If, on the other hand, basket 204 lifts or tips upward during insertion into or removal from image forming device 22, rib 222 on basket 204 contacts one or more of upstops 220 in order to limit the upward movement of basket 204 in housing 200 of image forming device 22 to protect electrical contacts 216, 218 and other components of image forming device 22 and toner cartridges 100 from damage. Further, in the embodiment illustrated, the flat segment 172 of each boss 160 serves as a continuation of rib 222 that may contact an upstop 220 on side frame 214 if basket 204 lifts or tips upward during insertion into or removal from image forming device 22. In this manner, flat segments 172 of bosses 160 help provide a more continuous upstop surface on basket 204.

Accordingly, the clearance 170 above each boss 160 provides space to accommodate upstops 220 on side frame 214 as drawer 202 including basket 204 slides into and out of image forming device 22. In this manner, the D-shaped configuration of boss 160 including partial cylinder 164 also helps reduce the height of image forming device 22 consistent with consumer preferences for smaller devices.

In the example embodiment illustrated, upon closing access door 208 of image forming device 22 when drawer 202 is fully inserted into housing 200 of image forming device 22, a linkage in image forming device 22 operatively connected to access door 208 lowers drawer 202 causing toner cartridges 100 to move vertically downward to their final operating positions in image forming device 22. The downward movement of toner cartridges 100 lowers electrical contacts 144, 146 of toner cartridge 100 into contact with corresponding electrical contacts 216, 218 in image forming device 22.

Figure 11:
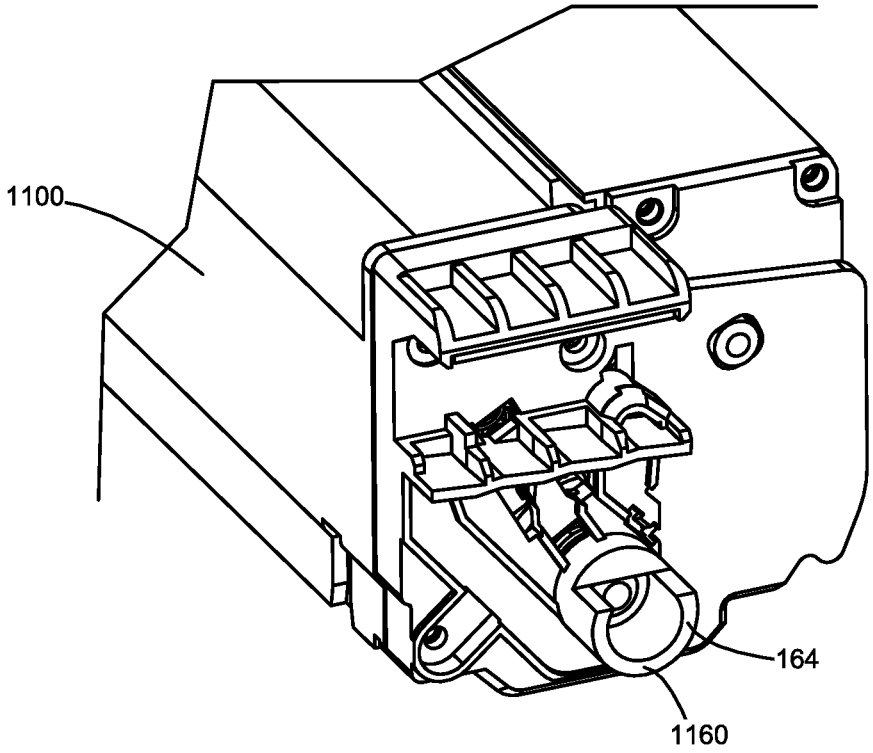
FIG. 11 is a perspective view of a toner cartridge according to another example embodiment.
Figure 12:
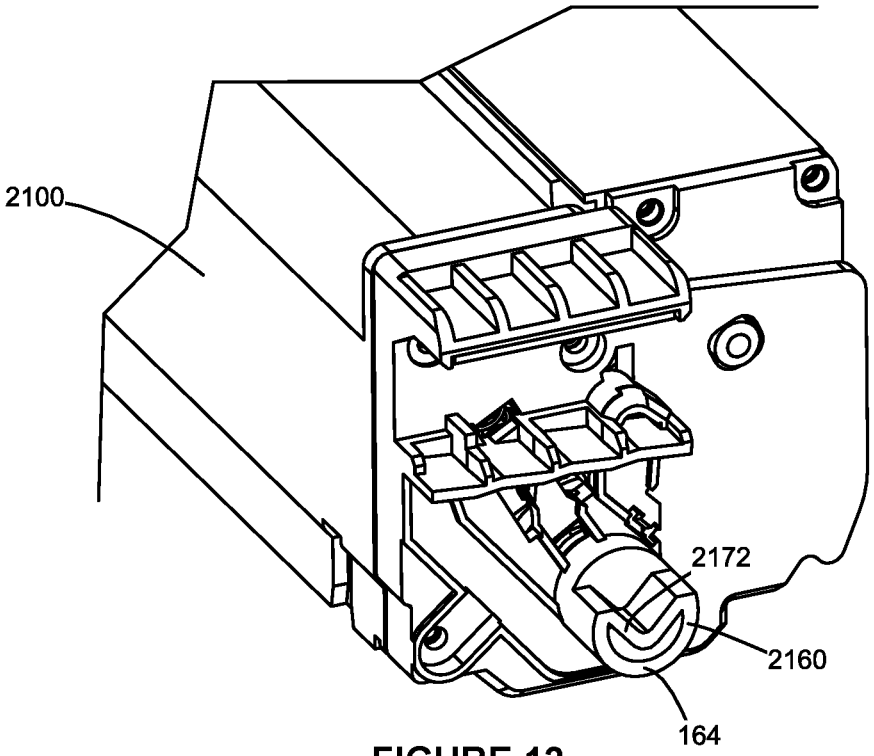
FIG. 12 is a perspective view of a toner cartridge according to another example embodiment.

Although the example embodiment discussed above includes a D-shaped boss 160, it will be appreciated that boss 160 may take other suitable shapes in order to provide accurate positioning of photoconductive drum 120 relative to image forming device 22 and to provide clearance to accommodate upstops 220. For example, FIG. 11 shows a toner cartridge 1100 including a boss 1160 having a partial cylinder 164 as discussed above, but omitting flat segment 172. FIG. 12 shows another example toner cartridge 2100 including a boss 2160 having a partial cylinder 164 as discussed above and a V-shaped top segment 2172 formed integrally with and on top of partial cylinder 164. These examples are not intended to be limiting and those skilled in the art will appreciate that many different shapes and configurations may be used to provide accurate positioning of photoconductive drum 120 relative to image forming device 22 and to provide clearance to accommodate upstops 220.

Further, although the example embodiment discussed above includes a single replaceable unit in the form of toner cartridge 100 for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device and the developer unit are provided in a first replaceable unit and the photoconductor unit is provided in a second replaceable unit. Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge, comprising:

a housing having a top, a bottom, a first side and a second side positioned between a first longitudinal end and a second longitudinal end of the housing, the housing has a reservoir for holding toner;

a photoconductive drum rotatably positioned on the housing, a portion of an outer surface of the photoconductive drum is positioned along the bottom of the housing, the photoconductive drum includes a rotational axis that runs in a direction from the first longitudinal end to the second longitudinal end;

a boss protruding outward from the first longitudinal end of the housing at the rotational axis of the photoconductive drum, an outermost axial segment of the boss along the rotational axis of the photoconductive drum includes a partial cylinder having a cross-sectional shape of a circular segment of less than 360 degrees circumference, an outer circumferential surface of the partial cylinder is convex to the bottom of the housing and forms a bottom contact surface of the boss that is unobstructed to contact and sit in a corresponding V-block in an image forming device when the toner cartridge is installed in the image forming device, the outer circumferential surface of the partial cylinder has a radius, wherein a volume of space above a topmost portion of the partial cylinder and within the radius of the outer circumferential surface of the partial cylinder at the outermost axial segment of the boss is free of material for accommodating one or more features in the image forming device during installation of the toner cartridge into the image forming device; and an electrical contact on the first longitudinal end of the housing for contacting a corresponding electrical contact in the image forming device when the toner cartridge is installed in the image forming device, the electrical contact of the toner cartridge is spaced above the boss.

2. The toner cartridge of claim 1, wherein the partial cylinder has a cross-sectional shape of a circular segment of greater than 180 degrees circumference.

3. The toner cartridge of claim 1, wherein the outer circumferential surface of the partial cylinder has a constant radius.

4. The toner cartridge of claim 1, wherein the radius of the outer circumferential surface of the partial cylinder is centered about the rotational axis of the photoconductive drum.

5. The toner cartridge of claim 1, wherein the outermost axial segment of the boss includes a flat segment that is positioned on top of the partial cylinder and that extends from a first circumferential end of the partial cylinder to a second circumferential end of the partial cylinder, wherein the volume of space is positioned immediately above the flat segment.

6. The toner cartridge of claim 1, further comprising a drive coupler on the second longitudinal end of the housing for mating with a corresponding drive coupler in the image forming device for receiving rotational motion from the corresponding drive coupler in the image forming device when the toner cartridge is installed in the image forming device, the drive coupler of the toner cartridge is operatively connected to the photoconductive drum to transfer rotational motion to the photoconductive drum.

* * * * *